United States Patent [19]

Karrer

[11] Patent Number: 4,543,676

[45] Date of Patent: Oct. 1, 1985

[54] METHOD OF LIQUID TREATMENT OF TEXTILE FIBER MATERIAL

[76] Inventor: Fritz Karrer, Strandvägen 37, 11456 Stockholm, Sweden

[21] Appl. No.: 525,611

[22] Filed: Aug. 22, 1983

[30] Foreign Application Priority Data

Aug. 25, 1982 [DE] Fed. Rep. of Germany ..... 3231578

[51] Int. Cl.[4] ..... D06B 5/06

[52] U.S. Cl. ..... 8/149.1; 8/155.1; 68/5 C; 68/189; 34/16; 34/105

[58] Field of Search ..... 8/149.1, 149.2, 149.3, 8/155.1, 158; 65/5 C, 20, 189; 34/105, 16, 115

[56] References Cited

U.S. PATENT DOCUMENTS

| | | | |
|---|---|---|---|
| 2,446,502 | 8/1948 | Wehrli | 8/149.1 |
| 2,936,212 | 5/1960 | Karrer | 8/149.1 X |
| 3,045,358 | 7/1962 | Breakell et al. | 34/105 X |
| 3,145,555 | 8/1964 | Krantz | 68/189 |
| 3,631,691 | 1/1972 | Karrer | 68/189 X |
| 3,762,866 | 10/1973 | Rayment et al. | 68/5 C X |
| 3,770,375 | 11/1973 | Naegeli | 8/149.1 |
| 3,771,954 | 11/1973 | Karrer et al. | 8/149.1 |
| 3,871,821 | 3/1975 | Winn et al. | 8/149.1 |
| 3,878,575 | 4/1975 | Wedler | 8/155.1 |
| 3,967,923 | 7/1976 | Ameling | 68/189 X |
| 4,084,412 | 4/1978 | Levielle | 68/5 C |
| 4,164,050 | 8/1979 | Stakelbeck | 68/5 C X |
| 4,369,035 | 1/1983 | Karrer et al. | 8/158 X |

FOREIGN PATENT DOCUMENTS

| | | | |
|---|---|---|---|
| 1067236 | 6/1954 | France . | |
| 12750 | 4/1976 | Japan | 8/149.3 |
| 712656 | 7/1954 | United Kingdom | 34/16 |
| 1488862 | 10/1977 | United Kingdom . | |

*Primary Examiner*—Philip R. Coe
*Assistant Examiner*—Frankie L. Stinson
*Attorney, Agent, or Firm*—Michael J. Striker

[57] ABSTRACT

Textile fiber material is dyed particularly quickly, uniformly, and gently by evacuating it unitl dry in a treatment vat, whereupon the dyeing liquor is introduced into the vat, avoiding any initial condensation in the fibrous material. This is achieved by introducing the dyeing liquor at a low temperature in harmony with the vacuum or by preheating the fibrous material to the necessary degree. After having been introduced, the dyeing liquor is subjected to slight excess pressure and caused to act on the fibrous material which, subsequently, is dried in the vat.

12 Claims, 1 Drawing Figure

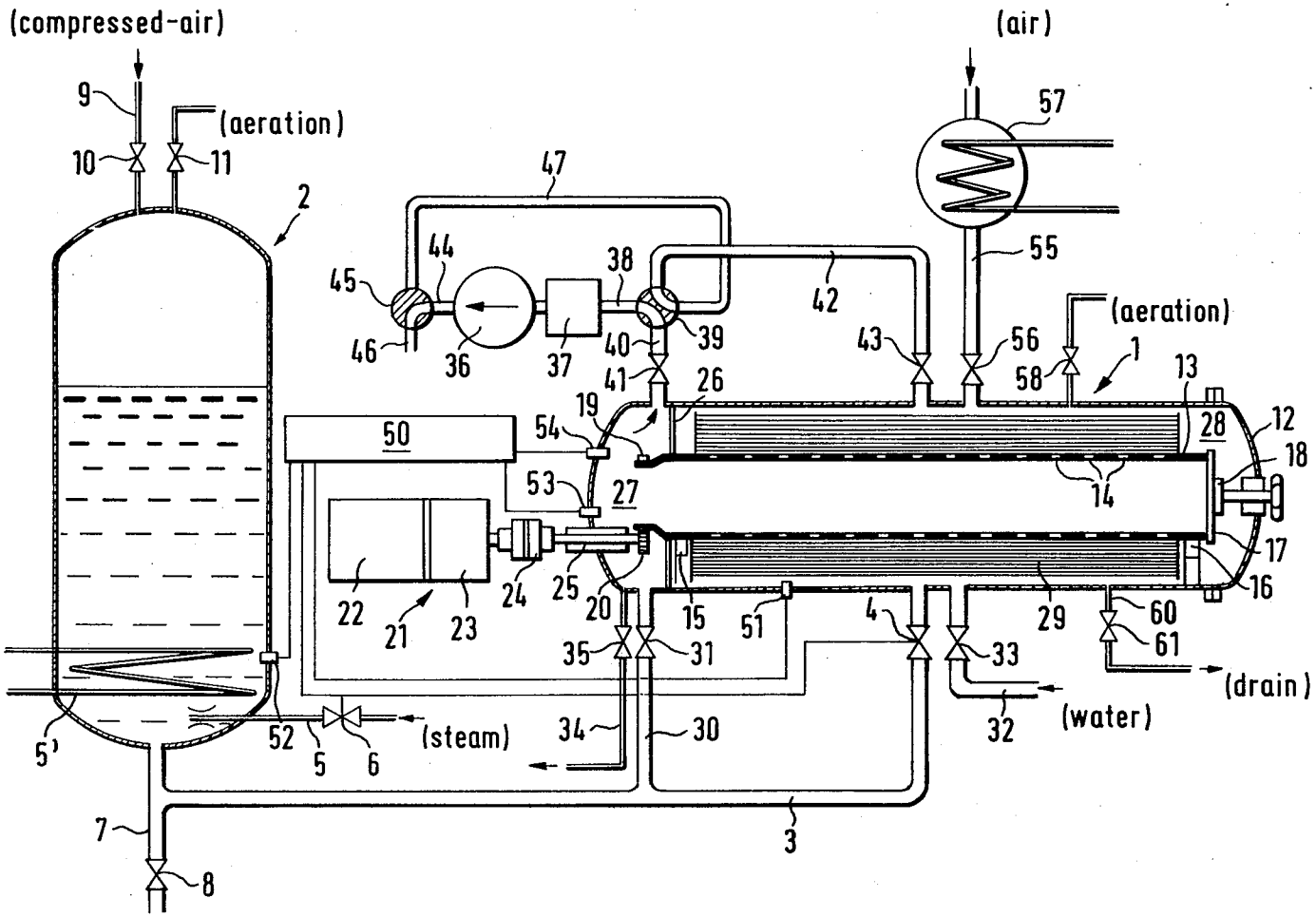
(air)
(aeration)
(drain)
(water)
(steam)
(aeration)
(compressed-air)

METHOD OF LIQUID TREATMENT OF TEXTILE FIBER MATERIAL

The invention relates to a method of liquid treatment of textile fiber material or the like, in particular of dyeing yarn, loose material or textile pieces, with which the fibrous material is put into a vat, the vat is evacuated until dry, the treatment liquid is introduced into the vat, the treatment liquid is caused to act on the fibrous material for a certain period of time, the treatment liquid is withdrawn from the vat, and the fibrous material is dried in the vat, if desired, after rinsing.

Such a method is already known (U.S. Pat. No. 3,631,691). With the known method the drying is effected in two stages because after withdrawal of the treatment liquid from the vat, first air and/or vapor is passed through the previously dyed fibrous material which thus is predried to a residual moisture content then vacuum is established and at the same time heat is supplied to finish dry the fibrous material, giving it its final moisture content.

The efficiency of the known method so far is limited above all by the duration of the action of the treatment liquid on the fibrous material, a duration which is necessitated in the interest of complete, uniform treatment or dyeing which, moreover, may also have to be protective for the material concerned. Another factor diminishing the efficiency is the duration of the drying.

It must be demanded in the interest of quick treatment or dyeing of the fibrous material that the treatment liquid or liquor have a high dyestuff concentration in the direct vicinity of the fibrous material. The dyestuff concentration in the ares of the fibrous material will sink, however, because of the withdrawal of dyestuff molecules entering into the fibers. The known method, therefore, provides for the use of a liquor which is set into circulating motion so as to achieve a constant balance of the dyestuff concentration and prevent any lowering of the diffusion speed at which dyestuff molecules penetrate the fibrous material and avoid uneven dyeing. Although this measure, in general, has a positive effect, it is not suited to speed up by a decisive degree the dyeing process which may take as much as 30 mintues.

It has been recognized before that the existing conditions upon introducing the treatment liquid into the vat are of decisive importance if quick and uniform dyeing is to be achieved (U.S. Pat. No. 3,878,575). Operations are carried out at a high vacuum or high excess pressure of the treatment liquid being introduced in order that the vat may be filled especially quickly with the treatment liquid which thus is intended to get into contact substantially at its starting concentration with all of the fibrous material. In this context, however, it was overlooked so far that the vacuum to which the fibrous material is exposed not only has the positive effect of removing moisture and air out of the fibrous material so that the treatment liquid introduced will have a better chance of contacting the fibrous material and entering into the same, but that it also entails a decisive negative effect. The latter resides in that immediately upon introducing the treatment liquid into the evacuated vat vaporization of this treatment liquid begins on the spur of the moment and that this vapor, being lighter than the treatment liquid, penetrates the fibrous material before the treatment liquid and is condensed again therein, at least in part. Thus the favorable conditions established by means of the preceding evacuation partly are cancelled because the condensate adhering to the fibrous material on the outside and inside will prevent the material from first being wetted by the treatment liquid which, instead, suffers dilution. Consequently, the method described still does not provide an entirely satisfactory solution.

It is therefore an object of the instant invention to provide for a reduction of the treatment time without having to put up with an uneven or ungentle treatment of the fibrous material.

This object is met, in accordance with the invention, in that, prior to introducing the treatment liquid into the vat, the temperatures of the fibrous material and of the treatment liquid as well as the pressure inside the vat are harmonized so that substantially no evaporating liquid will condense in or on the fibrous material as the treatment liquid is introduced.

The invention starts from the recognition that evacuating the vat has a positive preparatory influence on the fibrous material because the enclosed air bubbles will expand as the pressure is lowered so that the fiber pores will open and the capillary walls will be effected in a sense of substantially increasing the diffusion of the active substances of the treatment liquid. In this manner, for instance, even greater dyestuff molecules can penetrate quickly into the fibers where they will be caught. The removal of moisture from the fibrous material accompanying the evacuation is advantageous in that it permits wetting of the fibrous material with concentrated liquid which is not diluted by water adhering to the fibrous material. These advantageous circumstances now may be utilized fully because vapor condensation in the fibrous material is avoided in accordance with the invention.

The treatment liquid is introduced and brought into contact in its initial concentration with the dry fibrous material which is especially receptive of the active substances of the treatment liquid because of the preceding evacuation. Upon introduction, the treatment liquid enters abruptly and with unweakened concentration of the active substances into the fibrous material which thus is impregnated uniformly. It is obvious that the active substances thus may diffuse rapidly in the fibrous material. As the treatment time consequently is relatively short, the fibrous material at the same time will be protected. Furthermore, the rate of flow of the treatment liquid used may be much less as compared to the known method.

Tests have shown that the dyeing times required so far could be reduced very considerably by the method of the invention. Where the dyeing period so far was 30 minutes for instance, it could be lowered to no more than 3 minutes and yet provided absolutely perfect and uniform dyeing. This surprising result is believed to be due to the fact that the fibrous material which is opened up by the effect of the vacuum becomes soaked by the treatment liquid even before the swelling thereof in the fibrous material is terminated. The dyeing substance available in colloidal solution in the treatment liquid thus very effectively penetrates the capillary walls of the fibrous material which have been rendered porous. Obviously the remarkable reduction of the time of action needed makes the method more efficient and economic. Besides, known apparatus (e.g. Swiss patent 330 091) may be resorted to in order to practice the method of the invention, such apparatus perhaps requiring minor modification expenditure.

The teaching of the invention to avoid vapor condensation in or on the fibrous material may be realized in practice by preheating the fibrous material in the vat so that no vapor will condensate on the same, before introducing the treatment liquid. This preheating conveniently may be effected by having hot air flow through the vat to preheat the fibrous material.

Yet the teaching according to the invention also may be realized by introducing the treatment liquid at low temperature into the evacuated vat, this temperature being lower than the evaporating temperature which corresponds to the reduced pressure in the vat. In this case the formation of vapor is prevented as the treatment liquid is introduced. Therefore, vapor condensation in the fibrous material need not be feared. With this procedure the temperature of the treatment liquid introduced may be no more than 30° C. for example. In spite of this low temperature thorough dyeing of the fibrous material may be obtained within little time by virture of the effects described above. This variant of the method may be particularly important as it subjects the fibrous material to little stress only and thus the quality is maintained well, as the case of application may be. However, any deterioration of the quality such as felting largely may be avoided by the mere fact that the treatment time is relatively short. Finally, in the present case the saving of energy and operating costs is especially remarkable.

After the wetting of the fibrous material by the treatment liquid introduced any formation of condensed water in the fibrous material, presenting the disadvantage mentioned, is excluded. Therefore, the treatment liquid may be heated after having been introduced into the vat unless the peculiar character of the fibrous material should require corresponding gentle handling in any particular case. In this manner the influence of the treatment liquid on the fibrous material may be enhanced, if desired, and thus the treatment time may be reduced still further.

By contrast, vapor formation in the liquid or fibrous material after the introduction of the treatment liquid would have a negative influence and prolong the treatment period because vapor bubbles in the fibrous material would impair the full action of the treatment liquid on the fibrous material. Bubbles not only cause longer treatment periods but also increase the risk of uneven action or dyeing. To guarantee the success, it its provided with a particularly advantageous modification that atmospheric pressure or slight excess pressure is established in the vat after the introduction of the treatment liquid, and this atmospheric or elevated pressure is maintained for the duration of the action of the treatment liquid on the fibrous material. This pressure which may be in the range of from 1 to 1.5 bar not only prevents the formation of vapor but also has the advantageous consequence of removing any small air bubbles or pockets which may have remained in the fibrous material because such air bubbles will be compressed and their adherence to the fibrous material reduced so that they will rise through the treatment liquid. This also produces an improved effect of the treatment liquid on the fibrous material.

It is convenient to set the treatment liquid into pulsating motion during its action on the fibrous material. This motion has the effect of equalizing the concentration so that the active substances diffused into the fibrous material will be replaced. Such pulsation of the treatment liquid, particularly if effected by the vacuum pump associated with the vat (Swiss patent 330 091) may lead to signs of vaporization within the treatment liquid or fibrous material. For this reason the above mentioned elevated pressure during the time of action is of advantage in that any disturbing evaporation phenomenon is excluded positively.

The success of the method described according to the invention will have its full impact only if the time and energy gained are not lost again largely by the subsequent drying process. For this reason the drying is effected as with the known method described initially, namely first air and/or vapor is passed through the fibrous material after discharge of the treatment liquid out of the vat. In this manner the fibrous material is predried and will have only a residual moisture content. Thereupon vacuum is established and heat supplied simultaneously to give the fibrous material its final moisture content and finish drying it. The drying progresses rather quickly during the predrying or mechanical dehumidification by subjecting the fibrous material to a through-flow. Yet the residual moisture content is removed only slowly. It is taken up by way of volatilization by the medium of flow and then condensed in a condenser which is associated with the vacuum pump. The vacuum pump functions to maintain the air flow through the fibrous material. Moreover, the pressure reduced by the vacuum pump favors the evaporating process in the vat.

To speed up the drying process, it is provided with an advantageous modification of the method that the residual moisture is removed during the finish drying by evaporation caused by greatly reducing the pressure in the vat. The heat of vaporization is not supplied by a heat carrier such as air which, at the same time, serves to take up and remove moisture. Thus the residual moisture substantially is not volatilized but rather evaporated by way of the pressure reduction obtained by the vacuum pump. It is then withdrawn in vapor form through the vacuum pump and condensed in the condenser. As the vacuum acts substantially uniformly throughout the fibrous material, the evaporation and consequently the drying takes place throughout the fibrous material whereby the drying process is accelerated and rendered uniform, both of which factors contribute to the careful protective treatment of the fibrous material.

With the air flow drying so far moisture substantially is taken up only at those places which are swept over by the air. Yet it is known that flow through a fibrous material packing is not uniform, especially not if the thickness is rather great. Instead, the air flow attempts to follow paths of greater flow cross section thereby leading to local unevenness also in respect of the result of the drying. The channel forming tendency even increases as the drying progresses. Therefore, it is evident that the vaporization drying mentioned is superior to the volatilization drying used so far, the advantages not only residing in the quicker, more uniform and gentler drying but also in that the drying by vaporization may be effected by lowering the pressure by means of the vacuum pump which is available anyhow. In this context the energy requirement is reduced since the vacuum pump essentially only sucks off steam instead of having to treat air which it may have to do on a reduced scale only.

As the residual moisture evaporates, vaporization heat is withdrawn at the same time so that heat must be supplied to the vat or fibrous material during the finish drying. This heat may be applied to the fibrous material by radiation. As an alternative or in addition, high frequency energy (microwaves) may by applied to the fibrous material during the finish drying. It is also an advantage that alternatingly moisture may be evaporated from the fibrous material by lowering the pressure and the fibrous material, with the moisture still contained in it may be heated by hot air flowing through the same so as to balance the withdrawal of heat of vaporization.

The invention will be described further, by way of example with reference to the accompanying drawing which is a diagrammatic presentation of an apparatus for carrying out the method of the invention described.

The apparatus comprises an elongated cylindrical treatment vat 1 and a reservoir 2 for the treatment liquid arranged with its axis in vertical direction. The two vessels are interconnected by an overflow pipe 3 including an overflow valve 4. A vapor conduit 5 including a vapor valve 6 opens into the lower part of the reservoir 2. A conduit 7 including a valve 8 leads away from the bottom of the reservoir 2. This conduit serves for filling of the reservoir 2 with the treatment liquid, for instance a dyeing liquor, and also for discharge of the treatment liquid. The overflow pipe 3 is connected to the conduit 7. A compressed air line 9 including a compressed air valve 10 and furthermore a vent valve 11 are shown connected to the upper end of the reservoir 2. Moreover, a coil heat exchanger 5' is arranged in the reservoir 2 and either a heating medium or a cooling medium may be passed selectively through the heat exchanger to give the treatment liquid in the reservoir 2 the desired temperature.

At its right end the treatment vat 1 has a feed opening provided with a lid-type closure 12. An elongated cylindrical carrier 13 having perforations 14 in its peripheral surface is supported coaxially in the treatment vat 1 and for rotation by means of bearing-type supports 15 and 16. The right end of the carrier 13 is closed by a front plate 17 which is engaged by an adjustable retainer member 18 adapted to be removed together with the closure 12 and preventing axial displacements of the carrier 13. The carrier 13 is provided at its left end with an outer ring gear 19 in meshing engagement with a pinion 20 of a drive means 21 which comprises a motor 22, a transmission 23, a clutch 24, and a drive shaft 25, the latter passing in sealed fashion through the firmly closed front end wall of the treatment vat 1, in which wall it is supported, and carrying the pinion 20.

An annular partition 26 is provided in the treatment vat 1 so as to extend radially between the jacket of the treatment vat and the carrier 13 with which it is contiguous in sealed manner. Thus the vat 1 is divided into a discharge chamber 27 at the left end of the vat 1 and a fibrous material chamber 28. As the carrier is open at its left end which supports the ring gear 19, the interior of the cylindrical carrier 13 forms a central continuation of the discharge chamber 27. The chambers 27 and 28 are in fluid communication only through the perforations 14 formed in the carrier.

As illustrated, the fibrous material 29 to be treated is wound in layers on the carrier 13, and since the perforations 14 are provided only in the axial portion which is covered by the fibrous material 29, the fluid communication between the chambers 27 and 28 exists only through the fibrous material in addition to the perforations 14.

The overflow pipe 3 opens into the fibrous material chamber 28 at the underside of the vat 1. It is connected also to discharge chamber 27 by a branch pipe 30 including a valve 31.

Also a rinsing water pipe 32 including a rinsing valve 33 opens into the fibrous material chamber 28 at the underside of the vat. A discharge conduit 34 including a discharge valve 35 is connected to the underside of the discharge chamber 27.

A vacuum pump 36 with an upstream condenser 37 is associated with the treatment vat 1. The suction end of the vacuum pump 36 is connected through a suction line 38 and a fourway valve 39 by way of a line 40 including valve 41 to the discharge chamber 27, on the one hand, and by way of line 42 including valve 43 to the fibrous material chamber 28 on the other hand. The pressure end of the vacuum pump 36 is adapted to be connected through a line 44 and a changeover valve 45 selectively to an outlet connecting piece 46 or a return line 47 which likewise is connected to the fourway valve 39 so that it is adapted to communicate with the fibrous material chamber 28 or with the discharge chamber 27, alternating with the suction line 38. A control unit 50 is provided for control of the apparatus which control also may be effected manually at least in part if desired. As indicated, the control unit is connected by signal lines to a temperature sensor 51 in the treatment vat 1 and to a temperature sensor 52 in the reservoir 2 and also to a liquid level sensor 53 and a pressure sensor 54 in the discharge chamber 27. Further control lines pass from the control unit 50 to the valves. For reasons of clarity, however, they are not shown as leading to all valves to be actuated but instead only to valves 4 and 6.

An air conduit 55 which includes a valve 56 and into which an air heater 57 is connected likewise opens into the fibrous material chamber 28 at the top of the treatment vat 1. Moreover, a vent valve 58 and a drain pipe 60 including a valve 61 are connected to the treatment vat 1 in the range of the fibrous material chamber 28.

The mode of operation of the apparatus will be explained below: As the procedure begins, the treatment liquid (dyeing liquor) is filled into the reservoir 2. The treatment vat 1 is fed through closure 12 with the fibrous material 29 to be dyed. Upon closing of the vat 1 the vacuum pump 36 is operated while only valve 41 is open, as shown, whereas changeover valve 45 and fourway valve 39 adopt the positions illustrated in the drawing. In this manner vacuum is established inside the treatment vat 1. For example, the pressure in the vat is reduced to 0.2 bar (80% vacumm). Thereupon valve 56 is opened so as to introduce air into the fibrous material chamber 28 where it will flow through the fibrous material 29, being sucked off by the vacuum pump 36 which continues to maintain vacuum in the vat 1. The fibrous material 29 is structurally prepared in advantageous manner by the effect of the vacuum and the air flow through the same, the fibrous material perhaps giving off moisture it contains. This structural preparation is carried out for instance for a period of from 2 to 5 minutes.

If desired, the air heater 57 is operated during that time so as to preheat the fibrous material. The degree of preheating depends on the vacuum existing in the vat 1 and on the temperature of the treatment liquid in the reservoir 2. If the treatment liquid is cold, preheating of the fibrous material 29 perhaps may be dispensed with altogether. The temperature of the treatment liquid may be given a desired value by means of the heat exchanger 5'. It is also possible to heat the treatment liquid by introducing vapor through conduit 5.

Upon closing of valve 56 the overflow valve 4 is opened and then the treatment liquid spills over into the vat 1. The prevailing vacuum in the vat 1 and, possibly, excess pressure in the reservoir 2 produced by opening valve 10 cause the vat 1 to be filled quickly with treatment liquid which immediately spreads through the fibrous material 29. If desired, the fibrous material 29 may be rotated in the vat 1 by the drive means 21 at this point in time already. If the treatment liquid being introduced into the vat 1 should suffer vaporization because of its temperature and the vacuum cuum existing in the vat, no vapor will be condensed in the fibrous material 29 because, as described above, this has been preheated or warmed up to the required degree.

When the vat 1 has been filled, the vacuum pump 36 is shut down and the changeover valve 45 is actuated so that lines 44 and 47 will be connected to each other and the system will be closed. Introducing compressed air through line 9 into the reservoir 2 will cause slight excessive pressure of 1.2 bar, for instance, to build up in the treatment vat 1, whereupon the overflow valve 4 is closed.

During the subsequent phase of treatment the treatment liquid acts on the fibrous material 29 which is being rotated by the drive means 21. After having opened both valves 41 and 43, the vacuum pump 36 is operated again and the fourway valve 39 is moved to and fro so that both chambers 27 and 28 will communicate alternatingly and in opposed sense with the suction and pressure ends of the vacuum pump 36. This will cause pulsating motion in the treatment liquid between the two chambers 27 and 28 and through the fibrous material 29. This phase of treatment may be continued for 3 minutes for instance and then the vacuum pump 36 is shut down, valves 41 and 43 are closed, and valves 4 and 31 are opened in order that the treatment liquid may be returned into the reservoir 2. This is effected with the compressed air valve 10 closed and the vent valve 11 opened by introducing compressed air through conduit 55.

This is followed by a rinsing phase during which rinsing water is filled into the vat 1 through pipe 32, with valves 33 and 58 in open position, until the vat 1 is filled about half with rinsing water. At the same time, changeover valve 45 is returned once more into the position shown in the drawing, valve 41 is opened, and vacuum pump 36 is operated again. The carrier 13 with the fibrous material 29 is continued to be rotated also during the rinsing phase so that successive portions of the fibrous material in circumferential direction will be rinsed and drained alternatingly. Subsequently, when valves 35 and 61 have been opened, the rinsing water is discharged through discharge conduit 34 and drain pipe 60. If desired, the rinsing procedure may be repeated.

After the rinsing, the fibrous material 29 is dried in the treatment vat 1. This drying is effected in two stages. The first stage consists of draining water by passing air through the fibrous material 29. This is done by the vacuum pump 36, and the four-way valve 39 and the changeover valve 45 again are in their positions as shown in the drawing, while valves 41 and 56 are open so that air may flow through conduit 55 into the vat. During this phase the vacuum pump functions to pass air through the fibrous material without creating a vacuum worth mentioning in the vat 1. When the water drain phase is terminated, the air heater 57 is operated to transmit heat to the fibrous material 29.

This is followed by finish drying of the fibrous material 29. To this end the valve 56 is closed and a strong vacuum is created in the vat 1 by means of the vacuum pump 36.

This will evaporate the moisture still contained in the fibrous material 29 and supply it to the condenser 37. In this way the drying can be effected relatively quickly within a short period of time.

The description above refers to the dyeing and drying of fibrous material which is wound in the form of pieces on the carrier 13. Other liquid treatments may be carried out in corresponding manner, and fibrous material of different form may be treated, such as yarn on cross-wound bobbins. In that case possibly the rotary movement of the fibrous material within the treatment vat may be dispensed with. The pulsating motion during the treatment phase may be replaced by circulation of the treatment liquid, or forced movement of the treatment liquid may be dispensed with altogether.

What is claimed is:

1. A method of liquid treatment of textile fiber material or the like, in particular of dyeing yarn, loose material, or textile pieces, with which the fibrous material is put into a vat, the vat is evacuated until dry, the treatment liquid is introduced into the vat, the treatment liquid is caused to act on the fibrous material for a certain period of time, the treatment liquid is withdrawn from the vat, and the fibrous material is dried in the vat, if desired, after rinsing, characterized in that the liquid is introduced into the vat under vacuum conditions, and prior to introducing the treatment liquid into the vat the temperatures of the fibrous material and of the treatment liquid as well as the pressure inside the vat are harmonized so that substantially no evaporating liquid will condense in or on the fibrous material as the treatment liquid is introduced.

2. The method as claimed in claim 1, characterized in that prior to introducing the treatment liquid the fibrous material in the vat is preheated to such degree that no vapor will condense on the same.

3. The method as claimed in claim 2, characterized in that the fibrous material is preheated by hot air flowing through the vat.

4. The method as claimed in claim 1, characterized in that the treatment liquid is introduced at a low temperature into the evacuated vat, which temperature is below the evaporating temperature corresponding to the reduced pressure in the vat.

5. The method as claimed in claim 1, characterized in that after having been introduced into the vat, the treatment liquid is heated.

6. The method as claimed in claim 1, characterized in that upon introduction of the treatment liquid into the vat, the latter is put under atmospheric or slight excess pressure which is maintained for the period during which the treatment liquid acts on the fibrous material.

7. The method as claimed in claim 6, characterized in that a pulsating motion is imparted to the treatment liquid while it acts on the fibrous material.

8. The method as claimed in claim 1 with which first air and/or vapor is passed through the fibrous material after discharge of the treatment liquid from the vat, thereby pre-drying the fibrous material to a residual moisture content, and then vacuum is established and heat supplied at the same time to finish the drying, giving the fibrous material its final moisture content, characterized in that during the finish drying the residual moisture is expelled by evaporation caused by corresponding great lowering of the pressure in the vat, the heat of vaporization not being supplied by a heat carrier such as air which at the same time serves to take up and remove moisture.

9. The method as claimed in claim 8, characterized in that the heat needed during the finish drying is applied to the fibrous material by radiation.

10. The method as claimed in claim 8, characterized in that during the finish drying high frequency energy is supplied to heat the fibrous material.

11. The method as claimed in claim 8, characterized in that alternatingly moisture evaporated from the fibrous material by lowering the pressure and the fibrous material with the moisture still contained in it is heated by hot air flowing through the same.

12. A method of liquid treatment of textile fiber material or the like, in particular of dyeing yarn, loose material, or textile pieces, with which the fibrous material is put into a vat, the vat is evacuated until dry, the treatment liquid is introduced into the vat, the treatment liquid is caused to act on the fibrous material for a certain period of time, the treatment liquid is withdrawn from the vat, and the fibrous material is dried in the vat, if desired, after rinsing, characterized in that prior to introducing the treatment liquid into the vat the temperatures of the fibrous material and of the treatment liquid as well as the pressure inside the vat are harmonized by preheating the fibrous material in the vat prior to introducing the treatment liquid to such degree that no vapor will condense on the same, or by introducing the treatment liquid into the evacuated vat at a low temperature which is below the evaporating temperature corresponding to the reduced pressure in the vat.

* * * * *